US011532451B2

(12) United States Patent
Patwardhan et al.

(10) Patent No.: US 11,532,451 B2
(45) Date of Patent: Dec. 20, 2022

(54) SHIELD APPARATUS AND CIRCUIT INTERRUPTER

(71) Applicant: Eaton Intelligent Power Limited, Dublin (IE)

(72) Inventors: Sujit Patwardhan, Pune (IN); James G. Maloney, Industry, PA (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 228 days.

(21) Appl. No.: 16/987,693

(22) Filed: Aug. 7, 2020

(65) Prior Publication Data

US 2022/0044900 A1 Feb. 10, 2022

(51) Int. Cl.
*H01H 71/12* (2006.01)
*H01H 73/18* (2006.01)

(52) U.S. Cl.
CPC ..... *H01H 71/121* (2013.01); *H01H 73/18* (2013.01)

(58) Field of Classification Search
CPC .. H01H 9/30; H01H 2009/305; H01H 71/121; H01H 71/48; H01H 73/18
USPC ..... 335/15; 200/10, 304, 305, 50.22; 218/146, 77
See application file for complete search history.

(56) References Cited

U.S. PATENT DOCUMENTS

| | | | | |
|---|---|---|---|---|
| 4,266,210 | A * | 5/1981 | Mrenna | H01H 9/36 335/201 |
| 4,431,877 | A | 2/1984 | Heft et al. | |
| 4,484,045 | A * | 11/1984 | Seymour | H01H 73/18 218/41 |
| 4,716,265 | A | 12/1987 | Fujii et al. | |
| 5,723,841 | A * | 3/1998 | Kurono | H01H 71/002 218/147 |
| 5,780,800 | A | 7/1998 | Palmieri et al. | |
| 8,119,947 | B2 * | 2/2012 | Yang | H01H 71/0207 218/147 |
| 9,966,209 | B1 * | 5/2018 | Fasano | H01H 33/027 |
| 2007/0268100 | A1 * | 11/2007 | Schaltenbrand | H01H 9/34 335/201 |
| 2013/0153381 | A1 * | 6/2013 | Maloney | H01H 73/18 200/304 |
| 2014/0076700 | A1 * | 3/2014 | Lin | H01H 9/48 200/304 |

* cited by examiner

*Primary Examiner* — William A Bolton
(74) *Attorney, Agent, or Firm* — Eckert Seamans Cherin & Mellott, LLC

(57) ABSTRACT

A shield apparatus and a resultant circuit interrupter are disclosed, wherein the shield apparatus includes a shield apparatus base and a protection apparatus, with the protection apparatus including a shield that helps to direct an electrical arc along a flow path through a number of passages and that will help to enable dissipation of the arc and the plasma generated thereby. The shield apparatus is mountable to a portion of the housing of the circuit interrupter within its interior, and the shield is situated adjacent at least a first passage.

19 Claims, 9 Drawing Sheets

SHIELD APPARATUS AND CIRCUIT INTERRUPTER

BACKGROUND

Field

The disclosed and claimed concept relates to a circuit protection device and, more specifically, to a circuit interrupter and a shield apparatus thereof that resists damage due to electrical arcs.

Related Art

Circuit interruption devices are well known in the relevant art to protect a protected portion of the circuit from damage due to certain conditions such as overcurrent conditions, under-voltage conditions, ground fault conditions, arc fault conditions, and other conditions. It is generally understood that some circuit interrupters include one or more pairs of separable contacts that are movable between a CLOSED position and an OPEN position, and it is further understood that an electrical arc typically is formed between the contacts when they are moved from the CLOSED position to the OPEN position. Such arcs typically include a high temperature plasma that can damage components within a circuit interrupter, and such arcs therefore are preferably extinguished as soon as possible.

While such circuit interrupter said been generally effective for their intended purposes, they have not been without limitation. Circuit interrupters, particularly those formed to include a molded housing, have very limited space inside and the provisions that have been made to extinguish electrical arcs can be limited. Improvements would therefore be desirable.

SUMMARY OF THE INVENTION

These needs, and others, are met by at least one embodiment of this invention which provides an improved shield apparatus and a resultant circuit interrupter, wherein the shield apparatus includes a shield apparatus base and a protection apparatus, with the protection apparatus including a shield that helps to direct an electrical arc along a flow path through a number of passages that will enable dissipation of the arc and the plasma generated thereby. The improved shield apparatus is mountable to a portion of the housing of the circuit interrupter, and its shield is situated adjacent at least a first passage.

Accordingly, an aspect of the disclosed and claimed concept is to provide an improved shield apparatus and an improved circuit interrupter that includes such a shield apparatus, where the shield apparatus includes a shield apparatus base and a protection apparatus mounted to the housing of the circuit interrupter within an interior region thereof.

Accordingly, an aspect of the disclosed and claimed concept is to provide an improved shield apparatus usable with a circuit interrupter, the circuit interrupter having a housing and further having a set of separable contacts and an operating mechanism situated on the housing, the set of separable contacts including a stationary contact and a movable contact that are switchable between a CLOSED position and an OPEN position, the operating mechanism including a spring and a contact arm, the movable contact being situated on the contact arm, the contact arm being movable to switch the set of separable contacts between the CLOSED and OPEN positions, the shield apparatus can be generally stated as including a shield apparatus base structured to be situated on the housing, and a protection apparatus situated on the shield apparatus base, the protection apparatus can be generally stated as including a shield that extends away from the shield apparatus base, at least a part of the shield being situated between the stationary contact and the spring in the OPEN position of the set of separable contacts.

Another aspect of the disclosed and claimed concept is to provide an improved circuit interrupter, the general nature which can be stated as including a housing, a set of separable contacts situated on the housing and which can be generally stated as including a stationary contact and a movable contact that are switchable between a CLOSED position and an OPEN position, an operating mechanism situated on the housing and that can be generally stated as including a spring and a contact arm, the movable contact being situated on the contact arm, the contact arm being movable to switch the set of separable contacts between the CLOSED and OPEN positions, a shield apparatus that can be generally stated as including a shield apparatus base and a protection apparatus, the shield apparatus base being situated on the housing, and the protection apparatus being situated on the shield apparatus base, the protection apparatus can be generally stated as including a shield that extends away from the shield apparatus base, at least a part of the shield being situated between the stationary contact and the spring in the OPEN position of the set of separable contacts.

BRIEF DESCRIPTION OF THE DRAWINGS

A further understanding of the disclosed and claimed concept can be gained from the following Description when read in conjunction with the accompanying drawings in which:

Similar numerals refer to similar parts throughout the Specification.

DESCRIPTION

Figure 1:
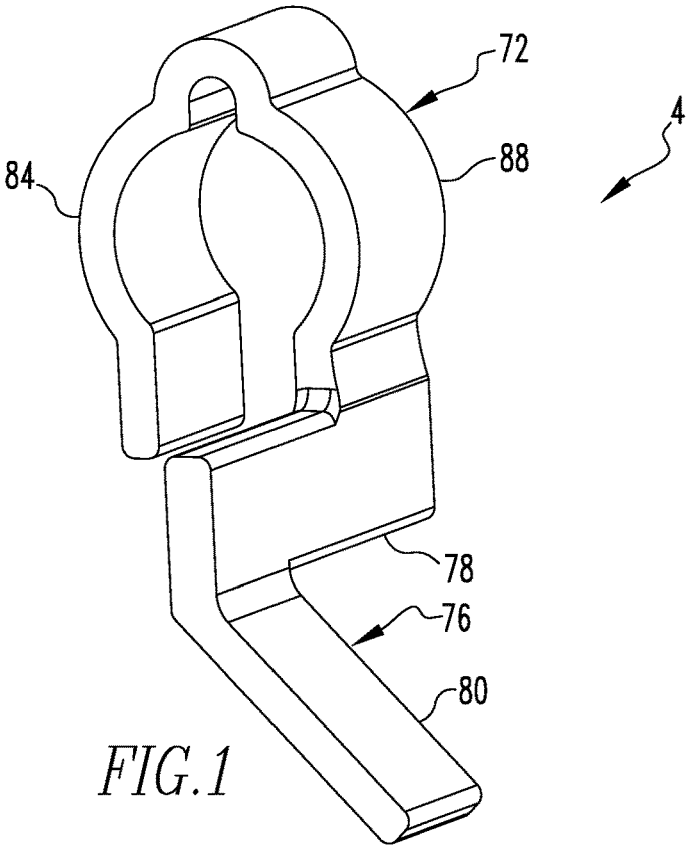
FIG. 1 is a perspective view of an improved shield apparatus in accordance with a first embodiment of the disclosed and claimed concept.
Figure 2:
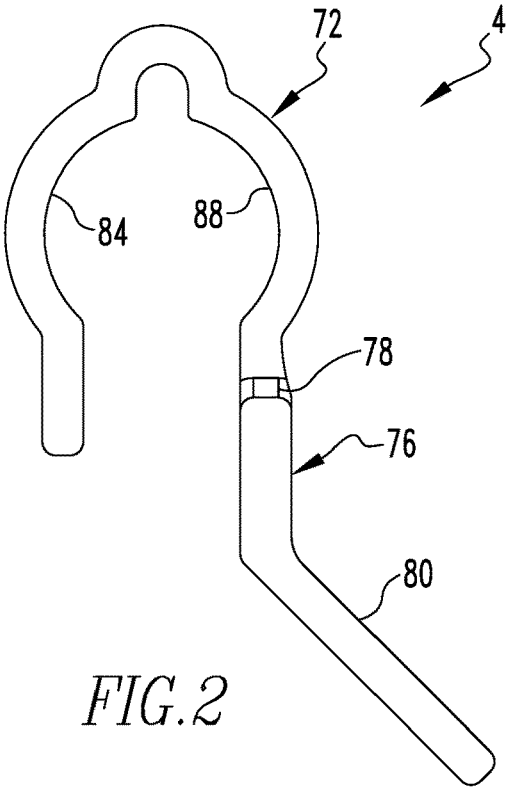
FIG. 2 is a frontal view of the shield apparatus of the first embodiment.

An improved shield apparatus 4 in accordance with a first embodiment of the disclosed and claimed concept is depicted generally in FIGS. 1 and 2. The shield apparatus 4 can be advantageously incorporated into an improved circuit interrupter 8 that is depicted generally in FIGS. 3 and 4 and which is depicted in part in FIGS. 5 and 6 and which is likewise in accordance with the disclosed and claimed concept. The circuit interrupter 8 is depicted in FIGS. 3-6 as including a housing 12 having an interior region 14, although it is understood that for purposes of clarity that another component of the housing 12 which attaches with the housing 12 and which encloses therein the interior region 14 is not depicted herein for reasons of simplicity of disclosure. As can be understood from FIGS. 3 and 4, the circuit interrupter 8 can be stated as including an operating mechanism 16 and a set of separable contacts 20 that are situated on the housing 12 and are disposed within the interior region 14. As noted, the circuit interrupter 8 additionally includes the shield apparatus 4.

Figure 3:
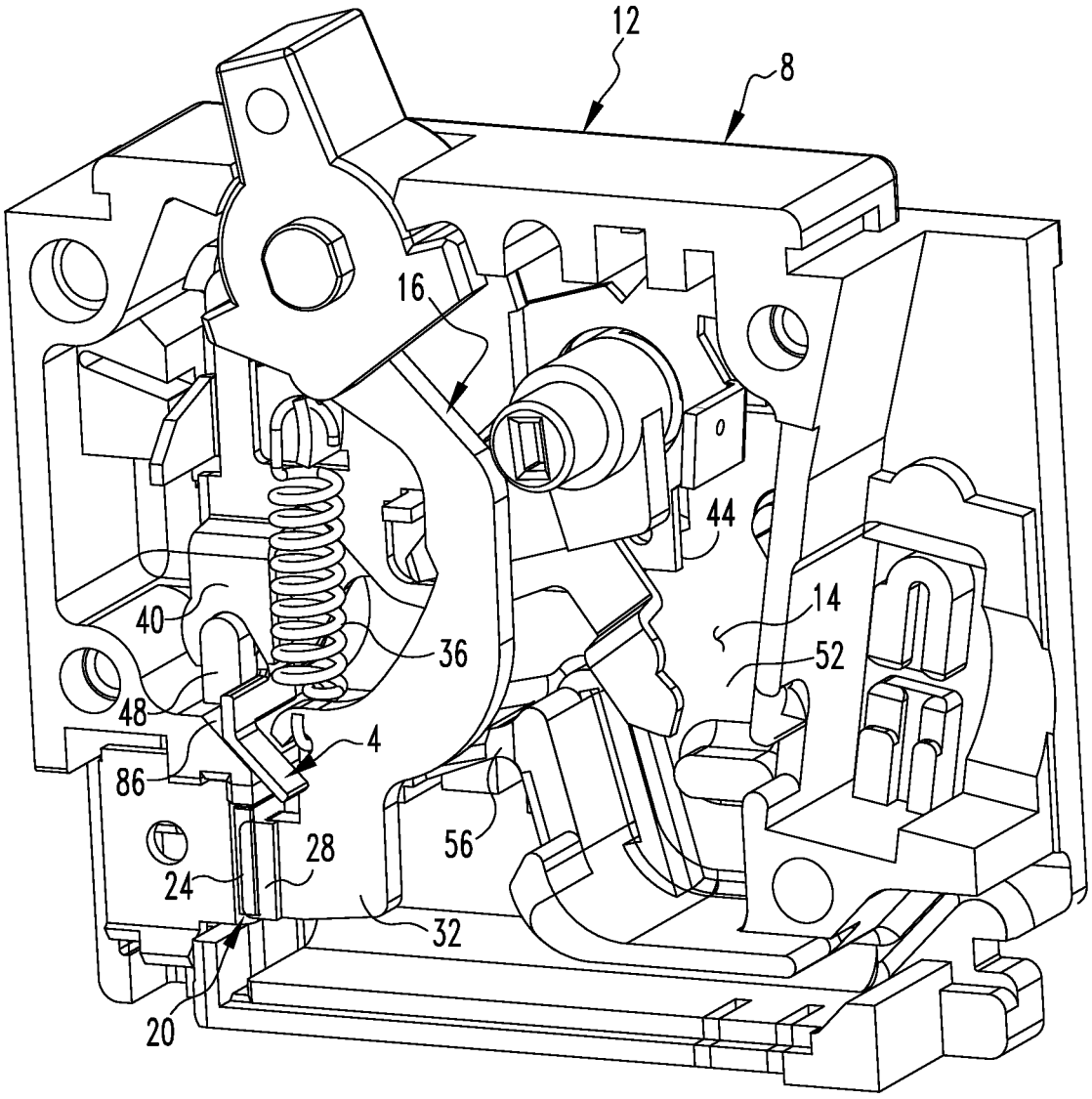
FIG. 3 is a perspective view of an improved circuit interrupter that incorporates the shield apparatus of the first embodiment and that is likewise in accordance with the disclosed and claimed concept and which depict a set of separable contacts in a CLOSED position.
Figure 4:
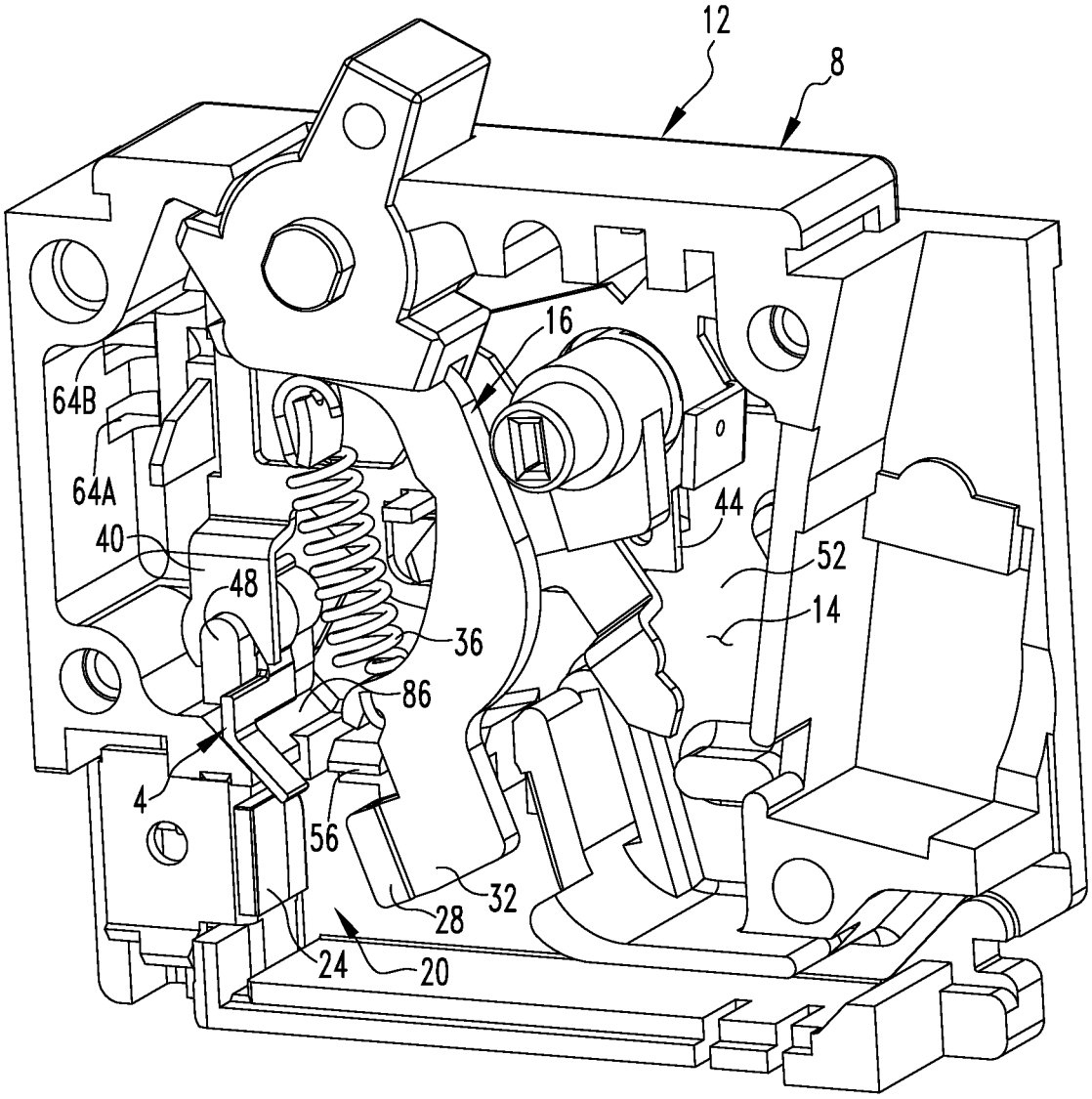
FIG. 4 is a view similar to FIG. 3, except depicting the set of separable contacts in an OPEN position.

As can be understood from FIGS. 3 and 4, the set of separable contacts 20 include a stationary contact 24 and a movable contact 28 that are movable between a CLOSED position as is depicted generally in FIG. 3 and an OPEN position such as is depicted generally in FIG. 4, it being understood that the operating mechanism 16 is operable to move the set of separable contacts 20 between the CLOSED and OPEN positions of FIGS. 3 and 4, respectively.

As can further be understood from FIGS. 3 and 4, the operating mechanism 16 can be said to include a contact arm 32, a spring 36 that extends between the contact arm 32 and the housing 12, a cradle 40, and a frame 44. As can be understood from FIG. 5, the housing 12 includes a boss 48 that protrudes outwardly from a housing base 52 of the housing 12 and into the interior region 14, and the shield apparatus 4 is receivable on the boss 48 to mount the shield apparatus 4 on the housing 12. The frame 44 is mounted with an interference fit to the boss 48.

Figure 5:
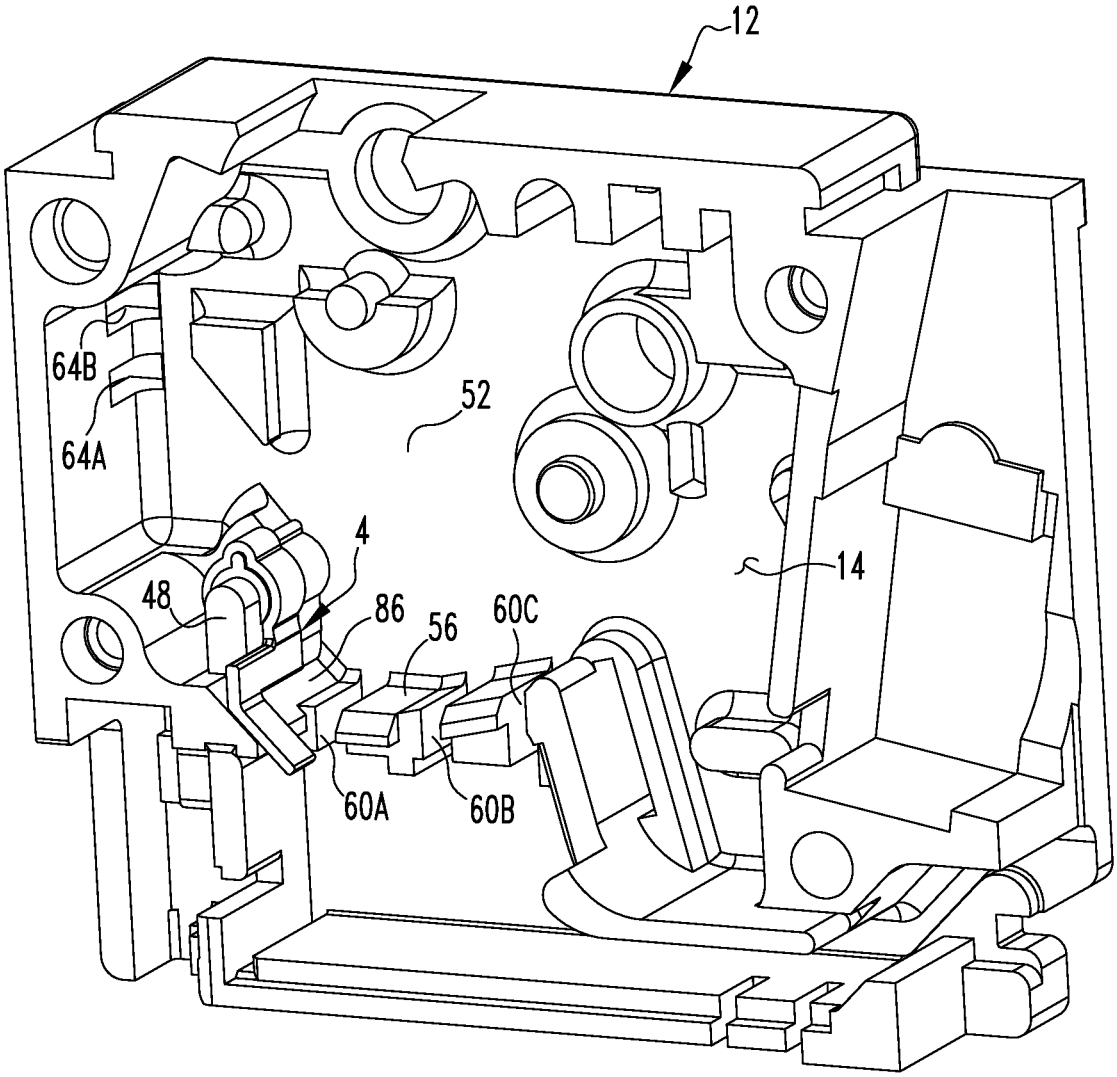
FIG. 5 depicts the shield apparatus of the first embodiment situated on a housing of the circuit interrupter of FIG. 3.
Figure 6:
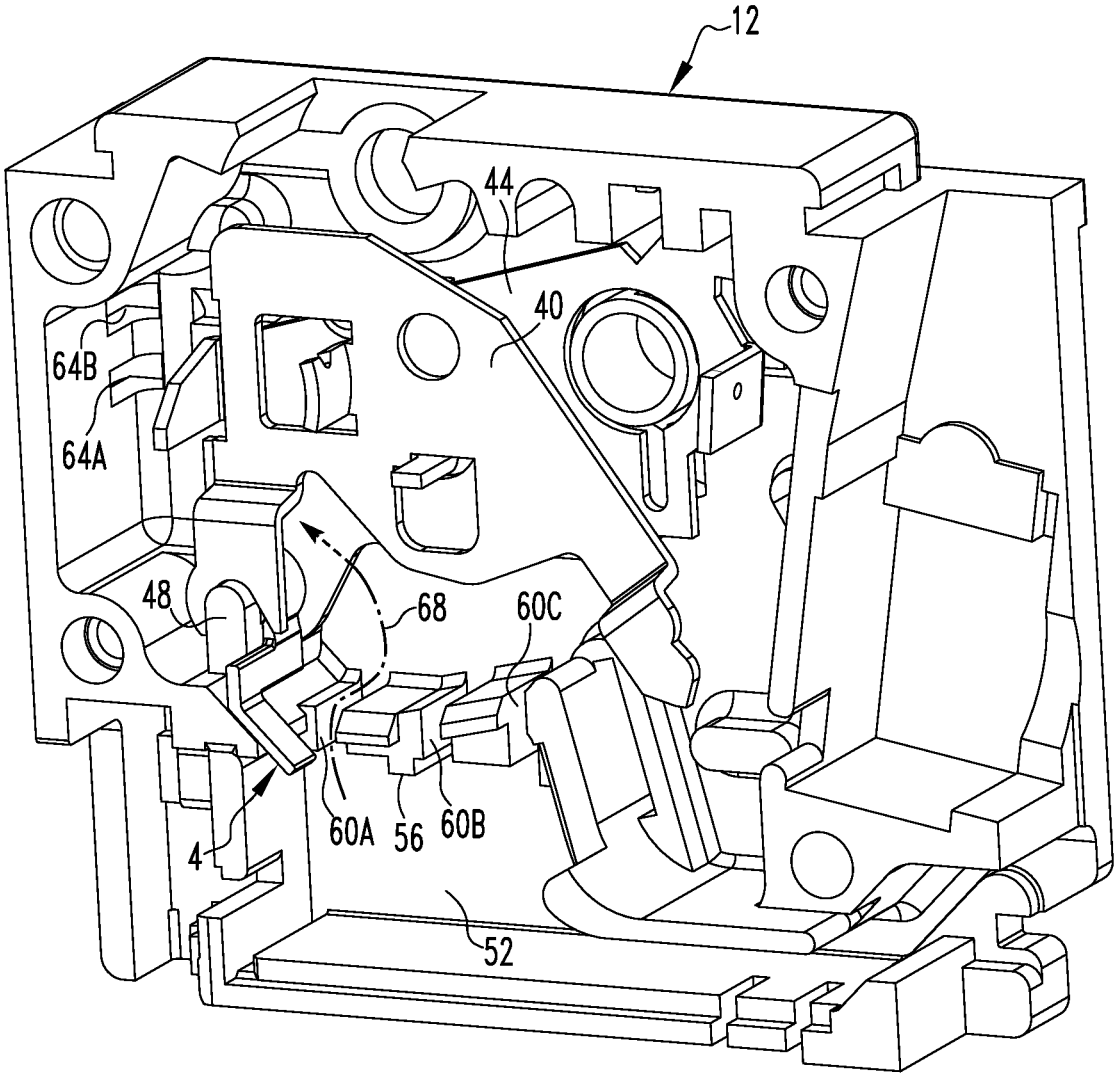
FIG. 6 is a view similar to FIG. 5, except additionally depicting a frame and a cradle of an operating mechanism situated on the housing.

As can further be understood from FIG. 5, the housing 12 additionally includes a dielectric wall 56 that protrudes outwardly from the housing base 52 and into the interior region 14. The dielectric wall 56 has formed therein a number of passages that are indicated at the numerals 60A, 60B, and 60C, and which may be collectively or individually referred to herein with the numeral 60. As employed herein, the expression "a number of" and variations thereof shall refer broadly to any non-zero quantity, including a quantity of one. As can further be understood from FIG. 5, the housing 12 has a pair of openings formed therein that are indicated generally at the numerals 64A and 64B, which may be collectively or individually referred to herein with the numeral 64, and that extend generally between the interior region 14 and an exterior of the circuit interrupter 8.

As can be understood, when the circuit interrupter 8 moves from the CLOSED position of FIG. 3 to the OPEN position of FIG. 4, an electrical arc typically is formed for at least a short time between the stationary and movable contacts 24 and 28. Such an electrical arc typically includes the formation of high temperature arc gases and a plasma that can be at a high-temperature and that includes components such as vaporized metal and the like, all of which is desirably extinguished and dissipated as soon as possible. The passages 60 are thus provided in order to cause the arc gases or the plasma or both to follow a flow path 68, such as is depicted generally in FIG. 6 and which extends generally through one or more of the passages 60. The plasma or the arc gases or both are then caused to flow out of the openings 64 to the exterior of the circuit interrupter 8.

In order to facilitate such flow and passage of the plasma or the arc gases or both, the flow path 68 includes a region, i.e., a space, that is situated generally between the frame 44 and the housing base 52. As such, the flow path 68 can be generally said to extend through the passages 60, through the space between the frame 44 and the housing base 52, and thereafter out of the openings 64 to the exterior of the circuit interrupter 8.

It is understood that an electrical arc typically is at its greatest intensity in the region closest to the stationary contact 24 since, as the movable contact 28 moves away from the stationary contact 24, the arc typically decreases in intensity while seeking to span the increasing distance between the set of separable contacts 20. The shield apparatus 4 is thus advantageously provided in the vicinity of the passage 60A in order to help direct any one or more of the arc, the plasma, and the arc gases into and through the passage 60A in order to facilitate the reception of such materials along the flow path 68 and through the space between the frame 44 in the housing base 52 and out of the openings 64.

As can be understood from FIGS. 1 and 2, the shield apparatus 4 can be said to include a shield apparatus base 72 and a protection apparatus 76. The protection apparatus 76 is situated on the shield apparatus base 72 and extends away from the shield apparatus base 72.

The protection apparatus 76 can be said to include a support 78 that is mounted to the shield apparatus base 72 and a shield 80 that is mounted to the support 78. The shield apparatus base 72 can be said to include a first leg 84 and a second leg 88 that are connected to one another and are together of an approximately partial ring-like shape. The protection apparatus 76 is situated on the second leg 88.

As can be understood from FIG. 5, the shield apparatus 4 is mountable to the housing 12 and is thereby incorporated into the circuit interrupter 8 by receiving the shield apparatus base 72 on the boss 48 such that the first and second legs 84 and 88 engage the boss 48. In the depicted exemplary embodiment, the shield apparatus base 72 is configured such that the boss 48 is interposed between the first and second legs 84 and 88. Moreover, the first and second legs 84 and 88 engage the boss 48 with a bias toward one another. As can be understood from FIG. 5, when the shield apparatus 4 is mounted to the boss 48, the shield 80 engages an abutment 86 of the housing 12 that protrudes outwardly from the housing base 52 and which helps to retain the shield 80 in the position depicted generally in FIG. 5.

As can be understood from FIGS. 3-6, when the operating mechanism 16 is operated to move the set of separable contacts 20 from the CLOSED position of FIG. 3 to the OPEN position of FIG. 4, any arc that forms between the set of separable contacts 20, along with any plasma or arc gases or both produced thereby, are directed along the flow path 68, which particularly includes the passage 60A, but that can additionally include either or both of the passages 60B and 60C, and that additionally flows into the space between the frame 44 and the housing base 52 to ultimately flow out of the openings 64 to the exterior of the circuit interrupter 8.

The shield apparatus 4 is typically formed as a single piece unit and can be formed from any of variety of appropriate materials including polymeric materials and other materials, whether or not additionally being filled with an aggregate material such as glass fibers or the like. Other variations will be apparent.

It thus can be seen that the improved shield apparatus 4 assists in directing the materials that result from an arc, including the arc itself, arc gases, plasma, and the like along the flow path 68 which advantageously avoids the arc gases and plasma from causing molten metal particles to deposit on the spring 36. That is, the deposition of arc products onto the spring 36 prematurely result in failure of the circuit interrupter 8. The improved shield apparatus 4 is advantageously situated in protective disposition between the stationary contact 24 and the spring 36 to protect the spring 36 from damage due to an arc formed between the stationary contact 24 and the movable contact 28. It thus can be seen that the shield 80 is situated generally between the stationary contact 24 and the spring 36 when the set of separable contacts 20 are in the CLOSED position and during at least a portion of the travel of the set of separable contacts 20 from the CLOSED position to the OPEN position. The shield apparatus 4 thus advantageously protects the internal componentry within the circuit interrupter 8 and increases the viable lifespan of the circuit interrupter 8, which is desirable. Other advantages will be apparent.

Figure 7:
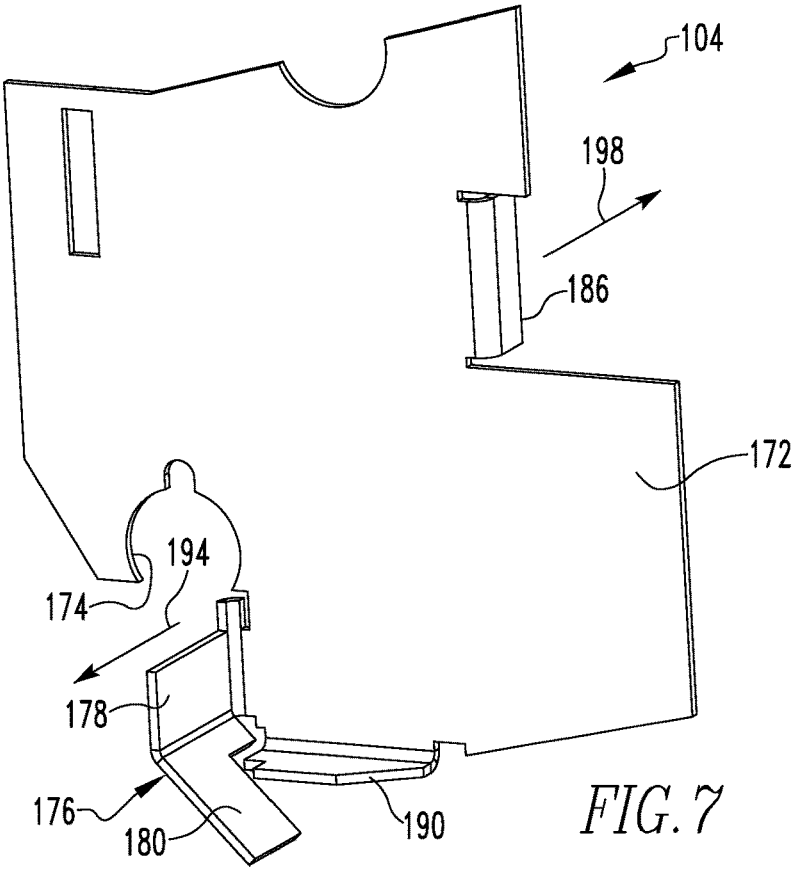
FIG. 7 is a perspective view of an improved shield apparatus in accordance with a second embodiment of the disclosed and claimed concept.
Figure 8:
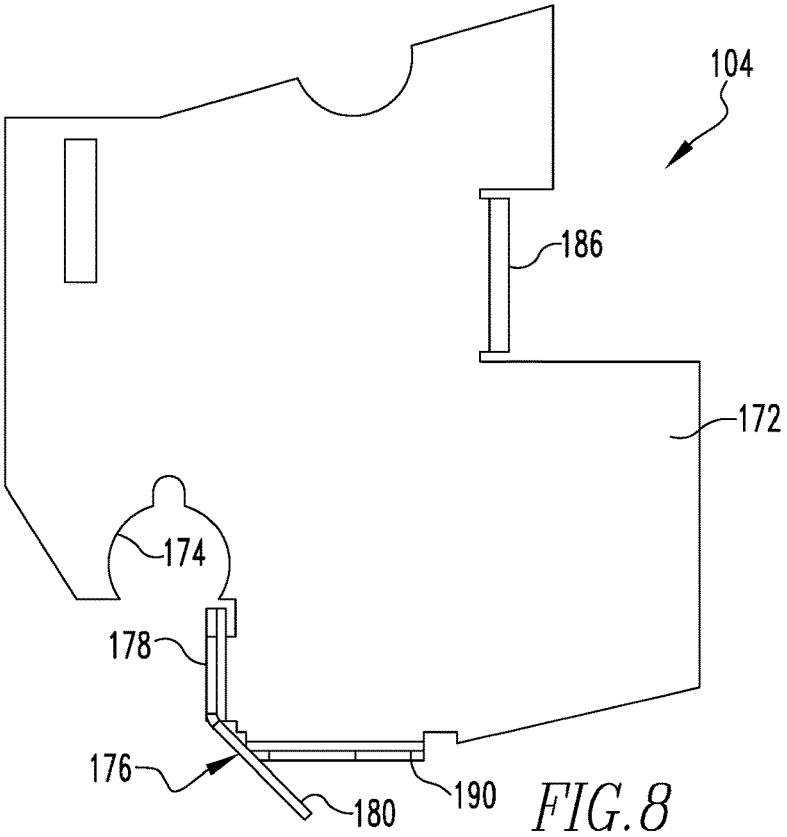
FIG. 8 is a frontal view of the shield apparatus of the second embodiment.
Figure 9:
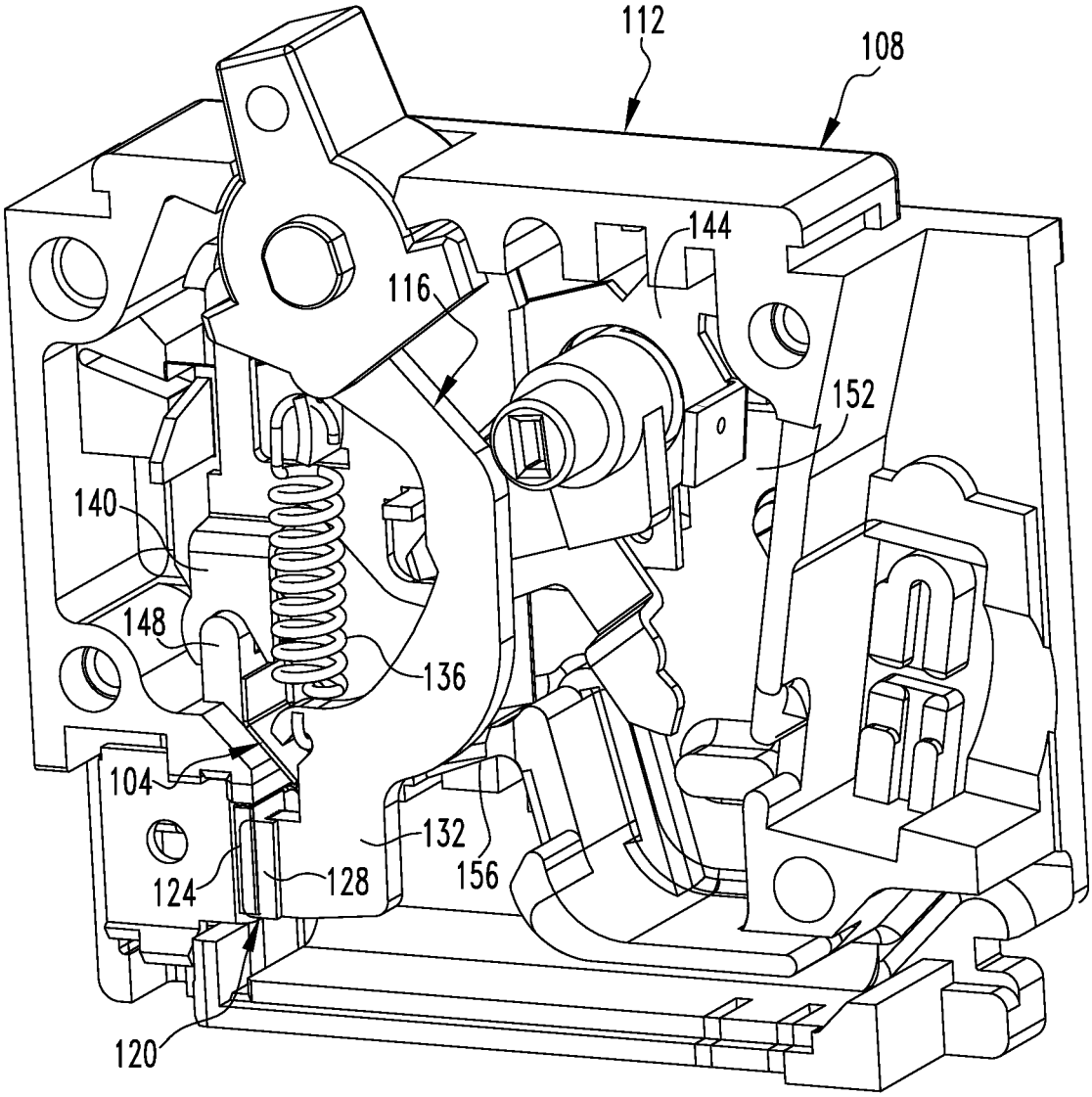
FIG. 9 is a perspective view of an improved circuit interrupter that incorporates the shield apparatus of the second embodiment and that is likewise in accordance with the disclosed and claimed concept and which depict a set of separable contacts in a CLOSED position.
Figure 10:
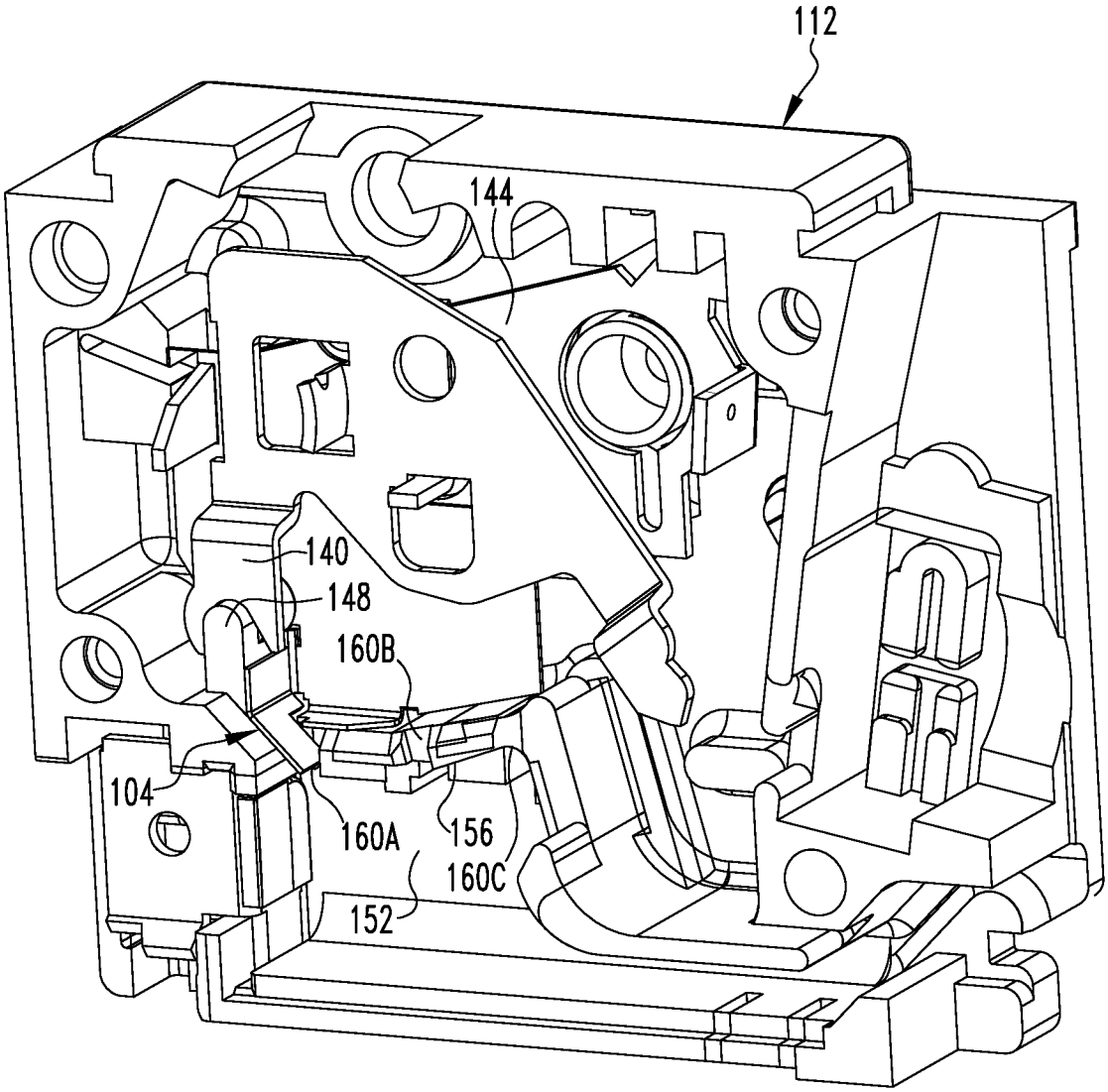
FIG. 10 depicts the shield apparatus of the second embodiment situated on a housing of the circuit interrupter of FIG. 9 and additionally depicts a frame and a cradle of an operating mechanism situated on the housing.
Figure 11:
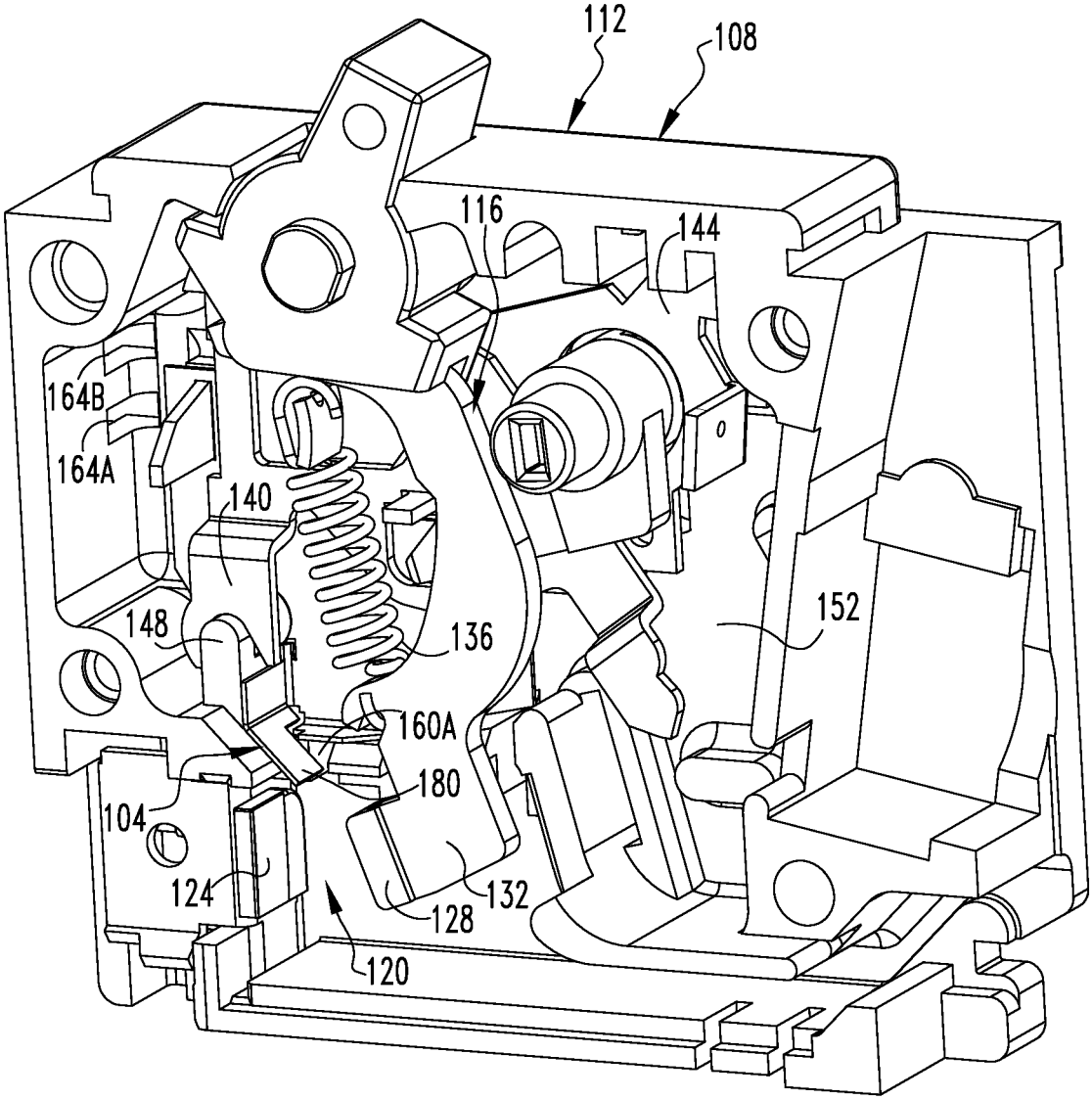
FIG. 11 is a perspective view of the circuit interrupter of FIG. 9 except depicting the set of separable contacts in an OPEN position.

An improved shield apparatus 104 in accordance with a second embodiment of the disclosed and claimed concept is depicted generally in FIGS. 7 and 8. As with the shield apparatus 4, the shield apparatus 104 is usable with and can be mounted in and incorporated into an improved circuit interrupter 108 that is likewise in accordance with the disclosed and claimed concept and that is depicted generally in FIGS. 9 and 11 and is depicted in part in FIG. 10. As before, the circuit interrupter 108 includes a housing 112 upon which are situated an operating mechanism 116 and a set of separable contacts 120 that includes a stationary contact 124 and a movable contact 128. The movable contact 128 is situated on a contact arm 132 of the operating mechanism 116, and a spring 136 extends between the contact arm 132 and the housing 12. The operating mechanism 116 further includes a cradle 140 and frame 144 that are mounted to a boss 148 that protrudes outwardly from a housing base 152 of the housing 112. The housing 112 further includes a dielectric wall 156 that protrudes outwardly from the housing base 152 and that has formed therein a set of passages that are indicated at the numerals 160A, 160B, and 160C, and which may be collectively or individually referred to herein with the numeral 160. As such, the circuit breaker 108 is the same as the circuit breaker 8, except that circuit interrupter 108 incorporates the shield apparatus 104 instead of the shield apparatus 4.

The shield apparatus 104 includes a shield apparatus base 172 and a protection apparatus 176, with the shield apparatus base 172 having an opening 174 formed therein that is receivable on the boss 148 to mount the shield apparatus 104 to the circuit interrupter 108. The shield apparatus 104 is of a generally sheet-like configuration and, in the depicted exemplary embodiment, is manufactured of a heat-resistant sheet of material such as fish paper or other appropriate material that is pressed into the shape shown generally in FIGS. 7 and 8. The shield apparatus base 172 in particular is sheet-like and planar and, as is indicated generally in FIG. 10, extends in the space between the frame 144 and the cradle 140.

The protection apparatus 176 can be said to include a support 178 that extends from the shield apparatus base 172 and a shield 180 that is situated on the support 178 and that extends therefrom. The protection apparatus 176 further includes a brace 186 that protrudes from the shield apparatus base 172 and that engages the frame 144. The protection apparatus 176 additionally includes a tab 179 that protrudes from the shield apparatus base 172 and that is situated adjacent the shield 180. As can be understood from FIG. 7, the support 178 and the tab 190 each extend away from the shield apparatus base 172 in a first direction that is indicated generally at the numeral 194, whereas the brace 186 extends away from the shield apparatus base 172 and a second direction that is indicated generally at the numeral 198, with the first and second directions 194 and 190 being opposite one another.

The shield 180 is likewise advantageously situated in protective disposition between the stationary contact 124 and the spring 136 to protect the spring 136 from an electrical arc that may be formed between the stationary contact 124 and the movable contact 128 and the arc products thereof. Furthermore, the shield 180, the tab 190, and the shield apparatus base 172 all help to direct the arc, the arc gases, and the plasma in a flow path through the passages 160 and through the space between the frame 144 and the housing base 152 in order to permit these and other products of the electrical arc to exit the circuit interrupter 108 at of a pair of openings that are indicated at the numerals 164A and 164B and that are formed in the housing 112 between the interior region and the exterior.

The shield apparatus 104 thus advantageously protects the improved circuit interrupter 108 from damage to the spring 136 due to the products of an electrical arc coming into contact with the spring 136 and depositing materials thereon. This is accomplished by helping to direct the products of the arc through the passages 160 and through the space between the frame 144 and the housing base 152 in order to avoid the arc products contacting the spring 136 and damaging it. This promotes enhanced lifespan of the circuit interrupter 108, which is advantageous. Other benefits will be apparent.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A shield apparatus usable with a circuit interrupter, the circuit interrupter having a housing and further having a set of separable contacts and an operating mechanism situated on the housing, the set of separable contacts including a stationary contact and a movable contact that are switchable between a CLOSED position and an OPEN position, the operating mechanism including a spring and a contact arm, the movable contact being situated on the contact arm, the contact arm being movable to switch the set of separable contacts between the CLOSED and OPEN positions, the shield apparatus comprising:

a shield apparatus base structured to be situated on the housing; and a protection apparatus situated on the shield apparatus base, the protection apparatus comprising a shield that extends away from the shield apparatus base, at least a part of the shield being situated between the stationary contact and the spring in the OPEN position of the set of separable contacts.

2. The shield apparatus of claim 1 wherein the protection apparatus is situated in protective disposition between the stationary contact and the spring structured to protect the spring from an arc formed between the stationary contact and the movable contact.

3. The shield apparatus of claim 1 wherein the housing includes a housing base and a boss that protrudes from the housing base, the shield apparatus base being structured to be situated on the boss.

4. The shield apparatus of claim 3 wherein the shield apparatus base includes a first leg that is structured to engage the boss and a second leg that is structured to engage the boss, the first and second legs being structured to interpose the boss between them.

5. The shield apparatus of claim 3 wherein the shield apparatus base includes a first leg that is structured to engage the boss and a second leg that is structured to engage the boss, the first and second legs being structured to bias the boss between them.

6. The shield apparatus of claim 1 wherein the housing includes a housing base, the shield apparatus base being sheet-like and being structured to extend along at least a portion of the housing base between the at least portion of the housing base and at least a portion of the contact arm in the CLOSED position of the set of separable contacts.

7. The shield apparatus of claim 6 wherein the housing further includes a boss that protrudes from the housing base, the shield apparatus base having formed therein an Opening that is structured to receive the boss therein.

8. The shield apparatus of claim 6 wherein the protection apparatus comprises a brace and a shield, the brace protruding in a direction away from the shield apparatus base, the shield extending from the shield apparatus base in another direction different than the direction.

9. The shield apparatus of claim 8 wherein the protection apparatus further comprises a tab that extends in the direction from the shield apparatus base.

10. A circuit interrupter comprising:

a housing;

a set of separable contacts situated on the housing and comprising a stationary contact and a movable contact that are switchable between a CLOSED position and an OPEN position;

an operating mechanism situated on the housing and comprising a spring and a contact arm, the movable contact being situated on the contact arm, the contact arm being movable to switch the set of separable contacts between the CLOSED and OPEN positions;

a shield apparatus comprising a shield apparatus base and a protection apparatus;

the shield apparatus base being situated on the housing; and the protection apparatus being situated on the shield apparatus base, the protection apparatus comprising a shield that extends away from the shield apparatus base, at least a part of the shield being situated between the stationary contact and the spring in the OPEN position of the set of separable contacts.

11. The circuit interrupter of claim 10 wherein the housing includes a housing base, the shield apparatus base being sheet-like and being structured to extend along at least a portion of the housing base between the at least portion of the housing base and at least a portion of the contact arm in the CLOSED position of the set of separable contacts.

12. The circuit interrupter of claim 11 wherein the housing further includes a boss that protrudes from the housing base, the shield apparatus base having formed therein an Opening that is structured to receive the boss therein.

13. The circuit interrupter of claim 11 wherein the protection apparatus further comprises a brace, the brace protruding in a direction away from the shield apparatus base, the shield extending from the shield apparatus base in another direction different than the direction.

14. The circuit interrupter of claim 13 wherein the protection apparatus further comprises a tab that extends in the direction from the shield apparatus base.

15. The circuit interrupter of claim 10 wherein the protection apparatus is situated in protective disposition between the stationary contact and the spring structured to protect the spring from an arc formed between the stationary contact and the movable contact.

16. The circuit interrupter of claim 10 wherein the housing includes a housing base and a boss that protrudes from the housing base, the shield apparatus base being situated on the boss.

17. The circuit interrupter of claim 16 wherein the housing includes a dielectric wall that extends from the housing base, the dielectric wall having a number of passages formed therein, the shield being situated adjacent a passage of the number of passages in at least the OPEN position of the set of separable contacts.

18. The circuit interrupter of claim 16 wherein the shield apparatus base includes a first leg that is structured to engage the boss and a second leg that is structured to engage the boss, the first and second legs being structured to interpose the boss between them.

19. The circuit interrupter of claim 16 wherein the shield apparatus base includes a first leg that is structured to engage the boss and a second leg that is structured to engage the boss, the first and second legs being structured to bias the boss between them.

* * * * *